United States Patent [19]

Riggs

[11] 4,300,781

[45] Nov. 17, 1981

[54] ROLLER SKATE BRAKING SYSTEM

[76] Inventor: Dennis D. Riggs, 415 Pile St., Ramona, Calif. 92065

[21] Appl. No.: 116,201

[22] Filed: Jan. 28, 1980

[51] Int. Cl.[3] ..... A63C 17/14

[52] U.S. Cl. ..... 280/11.2; 74/502; 188/2 D; 188/29

[58] Field of Search ..... 280/11.2, 11.21, 87.04 A, 280/87.04 R, 11.115; 180/180, 181, 333, 19 H, 272; 188/2 D, 24, 29, 74; 224/267, 226; 74/501 R, 501.5 R, 502, 503

[56] References Cited

U.S. PATENT DOCUMENTS

| | | | |
|---|---|---|---|
| 1,371,623 | 3/1921 | Ickenroth | 280/11.2 |
| 1,694,671 | 12/1928 | Rodelli | 280/11.2 |
| 1,801,205 | 4/1931 | Mirick | 280/11.2 |
| 1,892,260 | 12/1932 | Wick | 74/503 |
| 2,953,389 | 9/1960 | Green et al. | 280/87.04 A |
| 3,904,215 | 9/1975 | Bardy | 280/11.2 |
| 4,108,451 | 8/1978 | Scheck, Sr. | 280/11.2 |
| 4,167,225 | 9/1979 | Fragoso | 280/11.2 |

FOREIGN PATENT DOCUMENTS

| | | | |
|---|---|---|---|
| 2632555 | 2/1978 | Fed. Rep. of Germany | 280/11.2 |
| 264718 | 1/1927 | United Kingdom | 74/503 |

*Primary Examiner*—David M. Mitchell
*Attorney, Agent, or Firm*—Frank D. Gilliam

[57] ABSTRACT

A variable, easily actuated braking system for roller skates. A fixture carrying a hinged brake pad support is mounted on a conventional roller skate with the pads movable between a spring-assisted disengaged position and a sleeve and cable actuated engaged position. The cable is attached to the hinged support and the sleeve end to the fixture. Inner and outer actuator rings are attached to the other ends of the cable and sleeve, respectively. When the sides of the rings away from the attachment points are manually squeezed together, the pads are brought into braking engagement with the wheels. Strap means are provided for holding the ring actuators in easily reached positions along the outer upper thighs of the wearer. A self-aligning attachment is provided between the cable end and the brake pads to assure uniform, even braking. With such brakes on each skate, a user entering a sharp turn or steep downhill grade can ride with one skate ahead of the other and selectively apply the brakes, first on the rearward skate and then on both, to assure safe, smooth negotiation of the curve or hill.

8 Claims, 3 Drawing Figures

76
78
70
68
72
74
12
14
16
20
60
62
24
18
26
28
34
30
32
46
42
44
36
64
58
66
54
56
22
50
38
40

ROLLER SKATE BRAKING SYSTEM

BACKGROUND OF THE INVENTION

This invention relates in general to friction braking systems and, more specifically, to a system of that type for use with conventional roller skates.

Riding devices such as roller skates, skateboards, scooters, etc. where the rider stands on a relatively small platform or platforms have a number of problems in stopping or slowing which are not present with larger vehicles such as automobiles or bicycles. Great difficulties have been encountered in attempting to design braking systems for such devices. The center of gravity of the user of roller skates or the like is well above the wheels, so that any sudden stopping of the wheels tends to pitch the rider forward out of control. Also, roller skates or the like are small in size, making the addition of brakes difficult and brake operation hard to accomplish.

Brakes for skateboards, such as are described in U.S. Pat. Nos. 4,055,234 and 4,076,266, have been proposed. However, these brakes are difficult to operate, since a brake actuator must either be carried constantly in the rider's hand or must be operated by the foot, although the foot position for braking may not be ideal for balance while riding the skateboard in a turn.

A variety of braking schemes for roller skates have also been proposed. The conventional toe mounted snubber is not effective except at very low speeds. A braking system described in U.S. Pat. No. 2,140,955 uses a pair of pull cords extending from a brake mechanism to the rider's belt. This system, however, is mechanically inefficient and may result in undesired application of the brakes as the rider leans in turns, etc.

In another arrangement, as described in U.S. Pat. No. 2,179,592, a strap is connected from a brake lever to the back of the rider's leg, so that the brakes are automatically applied when the rider's legs are bent forwardly. This has the disadvantages that the brakes on both skates tend to be actuated together so that selective actuation is very difficult and the brakes may be unintentionally actuated when the rider bends into the wind or in a turn.

Thus, there is a continuing need for improvements in brakes for roller skates or the like in view of the number of problems with prior art systems.

SUMMARY OF THE INVENTION

The above-noted problems, and others, are overcome in accordance with this invention by a braking system which comprises a fixture adapted to be mounted adjacent to one wheel truck (preferably, the rear truck) on a roller skate, the fixture carrying a brake pad support hingedly connected to the fixture in a manner permitting brake pads thereon to be moved into and out of engagement with the skate wheels. A spring means is provided to maintain the brake pads out of engagement with the wheels except when manually actuated. A sleeve is connected between said fixture and an actuating means adapted to be strapped to the outside of the rider's upper thigh. A cable runs through said sleeve from said hinged support to the actuating means. When said actuating means is operated to pull said cable into said sleeve, the brake pads are moved into braking engagement with the heels.

This system keeps the brake actuating means close at hand, strapped to each of the rider's thighs, but does not require him to hold them in his hands at all times. The braking system on each of the skates may be operated independently or together with the other. For best balance and most effective braking when entering a curve or a steep downgrade at high speed, the rider may crouch with one skate in front of the other and first actuate the rearward skate brakes, then both together, usually with greater pressure on the rearmost skate. Thus, rapid effective braking can be accomplished while maintaining balance and control.

In a preferred embodiment of the actuating system, the sleeve is connected to a first or outer ring and the cable is connected to a first or outer ring and the cable is connected to a second ring within the first ring. The first ring is attached to a panel in a manner holding the rings substantially parallel with the rider's thigh when upright. The ring portions away from the sleeve and cable attachment points are grasped by the rider's hand and squeezed together to cause the braking action by pulling the cable into the sleeve. This squeezing action provides very sensitive, selective braking. The panel may be held in place on the rider's thigh be straps extending around the thigh and other straps extending over the rider's belt.

Preferably, the brake pad support is pivotably mounted on the hinge means so as to be self-aligning as the brake pads are brought into wheel engagement to assure smooth, even braking.

BRIEF DESCRIPTION OF THE DRAWING

Details of the invention, and of preferred embodiments thereof, will be further understood upon reference to the drawing, wherein.

DETAILED DESCRIPTION OF THE DRAWING

Figure 1:
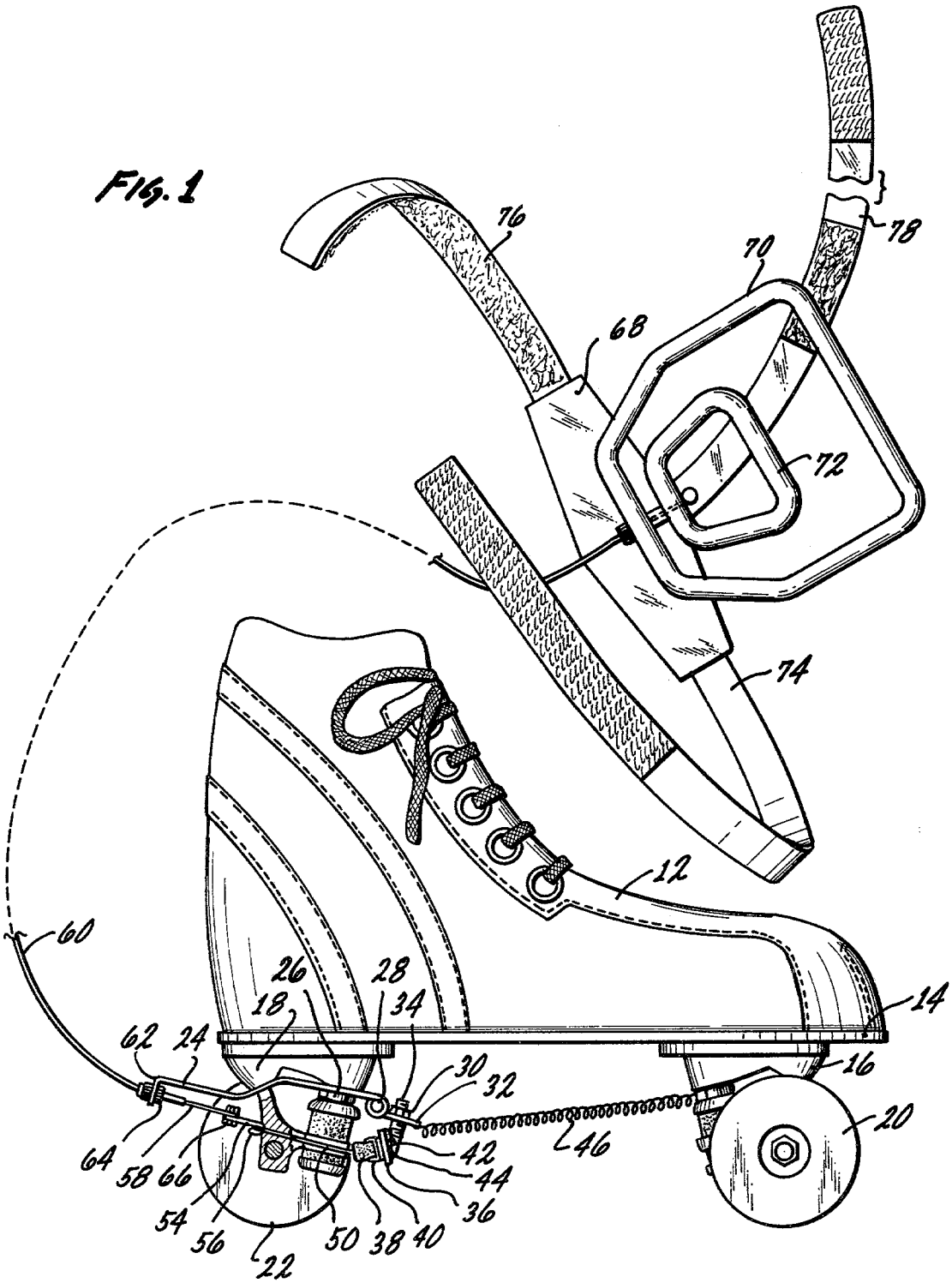
FIG. 1 is a side elevation view of a roller skate having the braking system of this invention mounted thereon with the nearest back wheel removed.

Referring now to FIG. 1, there is seen one of a pair of roller skates 10 having mounted thereon the braking system of this invention. Skate 10 is primarily made up of a shoe 12, a base plate 14 to which a front truck 16 and a rear truck 18 are mounted and which carry front and rear wheels 20 and 22, respectively. The near side rear wheel 22 is omitted for clarity in illustrating the braking system.

Figure 2:
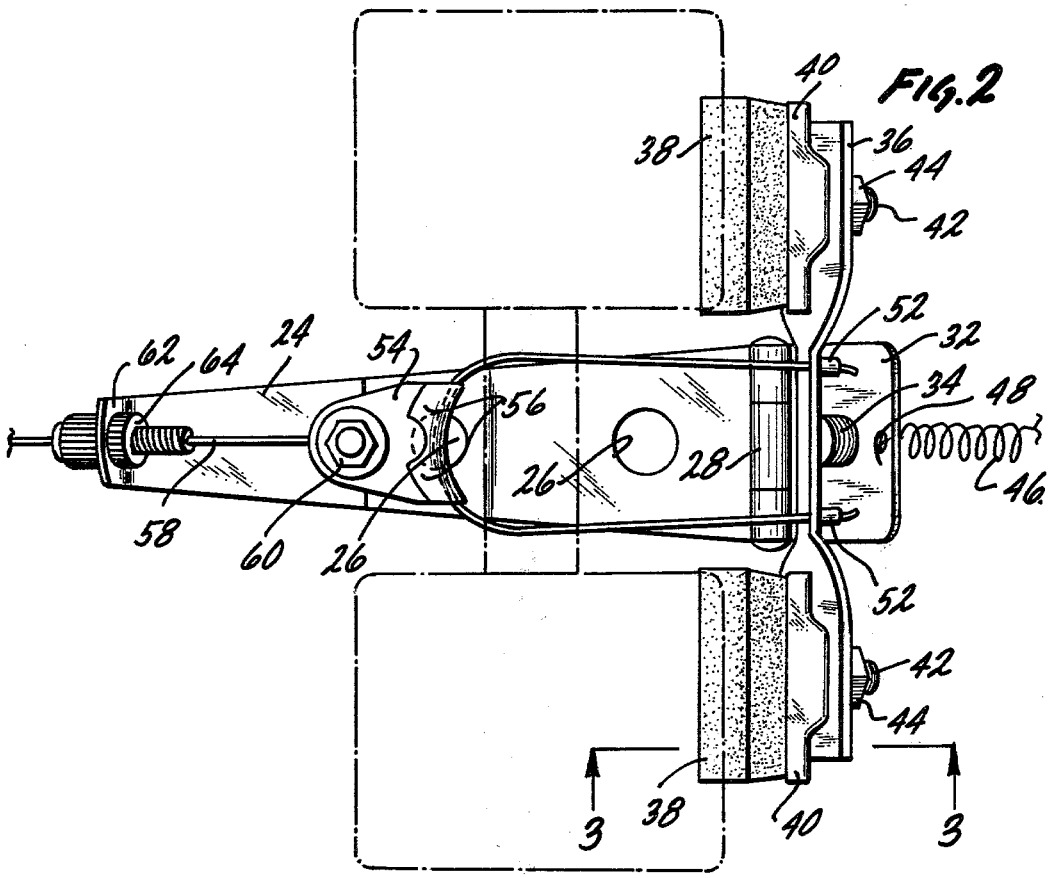
FIG. 2 is a bottom view of the roller skate brake fixture (removed from the roller skate) looking upwardly.

The braking system, as seen in FIGS. 1 and 2 is mounted on a fixture 24 which has two holes 26 through which the support members of truck 18 pass. Nut 26 on truck 18 serves to hold fixture 24 in place.

A hinge 28 is mounted at the front of fixture 24. A nut 30 is secured, such as by peripheral spot welds, to forwardly extending hinge portion 32. A stud 34 is threaded into nut 30. The lower end of stud 34 is cut off at an angle as shown and is fastened to a brake pad support bar 36 by any suitable means such as welding, bolts or rivets. Since stud 34 is movable in nut 30, support bar 36 is rockable about stud 34 as an axis. Of course, instead of nut 30, threads could be directly cut in a thicker hinge portion 32 and stud 34 could be machined integral with support bar 36. A pair of conventional brake pads 38 are mounted in metal cups 40, each having a stud 42 extending from the back thereof, passing through holes in support bar 36 and held in place by a nut 44. Bar 36 may be shaped in a manner providing optimum brake pad movement toward wheels 22.

The brake pads 38, when not in use for braking, are held out of engagement with wheels 22 by a tension spring 46 extending from a hole 48 in the frontmost edge of hinge portion 32 to a similar hole at the rear side of front truck 16.

Brake pads 38 are moved into a frictional braking contact with wheels 22 by an actuating means comprising a strand 50 (typically, a thin, strong, twisted wire) which extends in a loop around truck 18 between holes in support bar 36 on each side of the pivot axis provided by stud 34. The ends of strand 50 are kept from slipping through the support bar holes by any conventional means, such as crimped metal locking means 52, crimped in place near the ends of strand 50.

The loop formed by strand 50 rests in a groove in floating bracket 54 formed bending over fingers 56 to form a curved groove.

An actuating cable means 58 is attached to bracket 54 by a bolt and nut pair 66, with the bolt passing through a hole in bracket 54. Cable 58 passes into and through a sleeve 60, then to the actuation handle assembly.

Actuating cable 58 is secured to an upturned end 62 of fixture 24 by a conventional barrel nut assembly 64 which is adjustable to vary the position of the end of sleeve 60 relative to end 62.

The other end of sleeve 60 is fastened to a panel 68 and to a first or outer ring 70. The second end of cable 58 if fastened to second or inner ring 72. Rings 70 and 72 preferably have a "D" shape. When the straight portions of the "D" are grasped by a rider's hand and squeezed together, cable 58 is drawn further into sleeve 70, pulling strand 50 tight by means of bracket 54, drawing support bar 36 toward wheels 22 and bringing brake pads 38 into braking engagement with wheels 22. The portions of the handles to be grasped may be padded for comfort, if desired.

The arrangement of the loop strand 50 and floating bracket 54 produces much better and more uniform braking than would be the case if the end of cable 58 were directly connected to the center of bar 36. With the direct connection, brake pads 38 could bear unevenly on wheels 38. Since wheels 22 rotate independently on their axles, the two wheels would not be fully and evenly braked. With strand loop 50 and floating bracket 54, support bar 36 can "rock" about the axis provided by the threaded engagement of stud 34 and nut 30, so as to automatically self-align the brake pads with the wheels, so that pressure between each brake pad/wheel set will always be uniform.

While rings 70 and 72 could be held in the user's hands at all times, such an arrangement is undesireably awkward and tiring. Instead, strap means are provided to hold the brake actuating assemblies for the two skates in position along the rider's upper, outer thighs, where they can be quickly grasped in an emergency.

A first pair of straps 74 and 76 are adapted to encircle the rider's thigh. While any suitable buckle or tie arrangement may be used, for optimum adaptability, comfort and holding power, it is preferred that the end of one strap bear a pile surface and the other a hook surface of the sort sold under the "Velcro" trademark. With this material the straps are simply wrapped around the thigh and pressed together.

To prevent the assembly from slipping down the rider's leg during use, a second strap 78 is provided. This strap extends up, around the rider's belt, then back down and is fastened to itself. While any suitable fastening means may be used, again it is preferred that that two spaced portions be provided near the end of the strap, one being a "pile" surface and the other a "hook" surface of the sort available under the "Velcro" trademark. This material permits easy adjustment and rapid and convenient fastening and unfastening of the strap.

Figure 3:
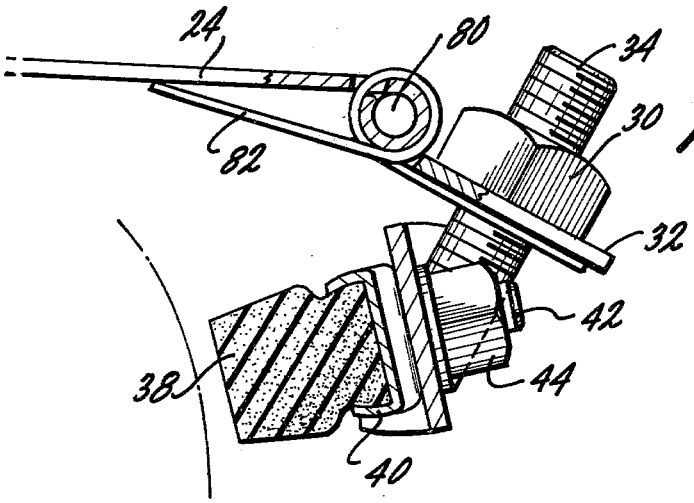
FIG. 3 is a partial sectional view taken on line 3—3 in FIG. 2, illustrating an alternate brake disengaging spring means.

While tension spring 46 as seen in FIG. 1 is effective in disengaging the brake when rings 70 and 72 are released, a second embodiment of the brake release means, which may be preferred for compactness is shown in FIG. 3. FIG. 3 illustrates, in section, a portion of fixture 24 in the region of hinge 28. As seen, hinge 28 includes a hinge pin 80 with (as best seen in FIG. 2) short extensions of fixture 24 bent around the ends of pin 80 and a central extension of hinge portion 32 bent around the center of pin 80. The space between two adjacent bent extensions can be enlarged and a compression spring 82 can be installed therebetween. Or, the spring could be placed around a slight extension of pin 80 at one end of the hinge. As seen in FIG. 3, spring 82 contacts the underside of fixture 24, winds at least once around pin 80, then extends along the undersurface of portion 32 next to stud 43 to bias portion 32 away from the wheels. When the brakes are actuated, brake pads 38 are moved downwardly and rearwardly, compressing spring 82. When the brake actuating means is released, the spring returns the system to the disengaged position.

Other variations, applications and ramifications of this invention will occur to those skilled in the art upon reading this specification. These are intended to be included within the scope of this invention as defined in the appended claims.

I claim:

1. A roller skate braking assembly comprising:

a fixture adapted to be mounted on a roller skate adjacent to one wheel truck thereof;

a brake pad support means hingedly mounted by a hinge means on said fixture;

brake pads on said support means, said pads adapted to be moved into and out of contact with wheels on said truck;

spring means normally biasing said pads away from said wheels;

sleeve means having one end secured to said fixture;

cable means having a first end connected to said support means and extending into and through said sleeve;

actuating means for moving said cable from said support means into said sleeve to move said support means to bring said pads into friction contact with said wheels, said actuating means comprises a first outer ring means attached to said sleeve, and a second ring means attached to said cable and located within said first ring means whereby the ring portions may be manually squeezed together to pull said cable through said sleeve and bring said pads into engagement with said wheels; and mounting means for releasably holding said actuating means to the upper outer thigh of a rider wearing said roller skate, said mounting means comprises a panel secured to said first ring means adapted to hold sleeve and ring means in alignment substantially parallel to the rider's thigh, a first strap means attached to said panel and adapted to encircle the rider's thigh and hold said panel thereagainst, a second strap means attached to said panel and adapted to engage said rider's belt to prevent said panel from slipping downwardly along said rider's leg.

2. The assembly according to claim 1 wherein each of said strap means includes a first portion having a pile surface and a second portion having a hook surface, whereby said portions when pressed together hold securely through hook and pile engagement.

3. A roller skate brake assembly comprising:

a fixture adapted to be mounted on a roller skate adjacent to one wheel truck thereof;

a brake pad support means hingedly mounted by a hinge means on said fixture;

brake pads on said support means, said pads adapted to be moved into and out of contact with wheels on said truck;

spring means normally biasing said pads away from said wheels; sleeve means having one end secured to said fixture;

cable means having a first end connected to said support means and extending into and through said sleeve;

actuating means for moving said cable from said support means into said sleeve to move said support means to bring said pads into friction contact with said wheels;

mounting means for releasably holding said actuating means to the upper outer thigh of a rider wearing said roller skate; and a pivotable attachment means between said brake pad support means and said hinge means permitting said pads to pivot slightly in a plane passing substantially through the wheel axis and wherein connection between said cable and support includes a strand extending from said support means near one pad, around a groove in a floating bracket and back to said support means near the other pad and wherein said cable is attached to said bracket at the end opposite said groove, whereby as said cable is operated to move said pads toward said wheels, said bracket may move slightly, said strand may slip slightly in said groove and said support means may pivot slightly so that equal pressure of each pad on each wheel is automatically assured.

4. A roller skate braking assembly comprising:

a fixture adapted to be mounted on a roller skate adjacent to one wheel truck thereof;

a brake pad support means hingedly mounted by a hinge means on said fixture;

brake pads on said support means, said pads adapted to be moved into and out of contact with wheels on said truck;

spring means normally biasing said pads away from said wheels, said spring means comprises a tension spring connected between an attachment point adjacent to the second skate wheel truck and an attachment point on said brake pad support means, whereby said spring urges said pads away from said wheels when said actuating means is released;

sleeve means having one end secured to said fixture;

cable means having a first end connected to said support means and extending into and through said sleeve;

actuating means for moving said cable from said support means into said sleeve to move said support means to bring said pads into friction contact with said wheels; and mounting means for releasably holding said actuating means to the upper outer thigh of a rider wearing said roller skate.

5. The assembly according to claim 3 or 4 wherein said actuating means comprises:

a first outer ring means attached to said sleeve; and a second ring means attached to said cable and located within said first ring;

whereby the ring portions away from the sleeve and cable attachments may be manually squeezed together to pull said cable through said sleeve and bring said pads into engagement with said wheels.

6. The assembly according to claim 5 where each of said ring means has a "D"-shaped configuration and the portions to be manually squeezed are straight.

7. The assembly according to claim 1 or 3 or 4 wherein said spring means comprises a tension spring having a central coil portion wrapped around a hinge pin in said hinge means, a first extended spring end pressing against said fixture and a second extended spring end pressing against said hinge means, whereby said spring moves said hinge means and brake pads away from said wheels when said actuating means is released.

8. The assembly according to claim 1, 3 or 4 wherein said brake pads are located immediately in front of the rear wheels of the roller skate and said cable and sleeve extend out of the rear underside of the skate, then upwardly to said actuating means.

* * * * *